US005513795A

United States Patent [19]

Sauerwine

[11] Patent Number: 5,513,795

[45] Date of Patent: May 7, 1996

[54] Z-FOLD MAILER WITH REUSEABLE REPLY ENVELOPE

[75] Inventor: Dean N. Sauerwine, Emmaus, Pa.

[73] Assignee: Moore Business Forms, Inc., Grand Island, N.Y.

[21] Appl. No.: 442,693

[22] Filed: May 17, 1995

[51] Int. Cl.[6] ..... B65D 27/06

[52] U.S. Cl. ..... 229/305; 229/306; 229/314

[58] Field of Search ..... 229/305, 306, 229/314, 316

[56] References Cited

U.S. PATENT DOCUMENTS

| | | | |
|---|---|---|---|
| 3,312,385 | 4/1967 | Amort . | |
| 3,334,806 | 8/1967 | Hiersteiner . | |
| 3,968,927 | 7/1976 | Katz et al. . | |
| 4,896,823 | 1/1990 | Taylor . | |
| 4,928,875 | 5/1990 | Hutchinson . | |
| 5,174,493 | 12/1992 | File . | |
| 5,201,464 | 4/1993 | File . | |
| 5,282,568 | 2/1994 | File | 229/305 X |
| 5,285,958 | 2/1994 | Buescher . | |
| 5,289,972 | 3/1994 | Sauerwine et al. | 229/305 X |
| 5,307,989 | 5/1994 | Dyer . | |
| 5,328,092 | 7/1994 | File | 229/306 |
| 5,372,302 | 12/1994 | Loch et al. | 229/305 |
| 5,402,934 | 4/1995 | Sauerwine . | |
| 5,425,500 | 6/1995 | Sauerwine | 229/305 X |

*Primary Examiner*—Jes F. Pascua
*Attorney, Agent, or Firm*—Nixon & Vanderhye

[57] ABSTRACT

An intermediate for a mailer type business form is formed from a quadrate sheet of paper which is Z-folded to produce a mailer type business form with a reply envelope, without windows or patches. A large amount of area is provided for printing yet the reply envelope produced accepts a conventional size personal check without folding. Outgoing address indicia is imaged on the top face of the first ply and a first line of demarcation (preferably a line of weakness) passes through that indicia, while a reply address indicia is imaged on the bottom face of the second ply and not intersected by the first line of demarcation. Aligned first and second lines of weakness are formed in the first and second plies parallel to the end edges of the mailer and spaced from the second end edge of the mailer a distance (e.g. about one half inch) large enough to contain postal bar coding between the first line of weakness and the second end edge, the postal address bar coding thus being removed when the outgoing envelope is opened. The return envelope flap is large enough to cover any remaining outgoing address indicia on the first ply top face when the reply envelope closing flap is folded over to seal the reply envelope.

20 Claims, 5 Drawing Sheets

Z-FOLD MAILER WITH REUSEABLE REPLY ENVELOPE

BACKGROUND AND SUMMARY OF THE INVENTION

Mailer type business forms must serve a wide variety of customer requirements. Depending upon particular needs, mailer type business forms must be specifically tailored to provide an acceptable product. Several features that are almost universally desirable, however, are the ability to print on a large amount of the mailer, yet still have a reply envelope, the ability to have a reply envelope that accepts a conventional size (i.e. six inch length) personal check without folding, and having a reply envelope flap that will fold to the back of the reply envelope, and to have a remittance coupon or stub portion which includes worthwhile information and that may easily be detached and inserted in the reply envelope for return along with the check. It is also desirable to be able to provide these features without a window or patch, and to allow imprintation of modern postal address bar coding on a ply of the outgoing envelope without that bar coding interfering with use of the same ply as part of the reply envelope.

According to the present invention, an intermediate for a mailer type business form, and the mailer itself, are provided which achieve the objectives set forth above. The intermediate comprises a single quadrate sheet of paper which may be easily run through a printer to print indicia on either one or both faces, with the same face having the outgoing address and reply address printed thereon so that they may be readily variably printed. The intermediate may be easily Z-folded to form the final mailer, and sealed by conventional techniques. The mailer is easy to open and the reply envelope is easy to utilize.

According to one aspect of the present invention an intermediate for a mailer type business form comprises the following components: A substantially opaque quadrate sheet of paper having parallel top and bottom edges, parallel first and second side edges perpendicular to the top and bottom edges, and first and second faces. First and second fold lines parallel to the top and bottom edges, and defining the sheet into substantially equal-size first, second, and third panels, the first panel between the top edge and first fold line, and the second panel between the first and third panels. A first line of demarcation disposed parallel to the first side edge extending the majority of the dimension of at least the first and second panels parallel to the side edges, the first line of demarcation closer to the first side edge than the second side edge, and defining a flap in each of the first and second panels between the first line of demarcation and the first side edge. Means defining an outgoing address area on the first face of the first panel, the first line of demarcation passing through the outgoing address area. Means defining a reply address area on the first face of the second panel, the reply address area spaced from, and not intersected by, the first line of demarcation in the second panel, the reply address area between the first line of demarcation and the second side edge. First permanent adhesive patterns provided on at least one of the first and second panel second faces for defining the first and second panels into a reply envelope having permanent adhesive on first through third sides thereof when the first and second panels are Z-folded about the first fold line so that the second faces thereof are in face-to-face engagement. A reply envelope closing flap formed by the second panel flap, and having activatable adhesive on the second face thereof for sealing a reply envelope on a fourth side thereof. First and second lines of weakness formed in the first and second panels, respectively, parallel to the top and bottom edges and straddling the first fold line, the first line of weakness spaced from the first fold line a distance large enough to contain postal address bar coding between the first line of weakness and the first fold line on the first face, but the first line of weakness not interfering with the outgoing address area. Third and fourth lines of weakness formed in the first through third panels parallel to and spaced from each of the first and second side edges. The first through fourth lines of weakness defining tear-off strips providing for ready opening of a mailer constructed by Z-folding the sheet about the fold lines. And, second permanent adhesive patterns provided in at least some of the tear-off strips for holding the first through third panels together in an outgoing mailer when the sheet is Z-folded about the fold lines.

In the intermediate as described above the first line of demarcation may be a line of weakness, at least in the first panel. Also preferably a fifth line of weakness is formed in the third panel parallel to the bottom edge and spaced from the bottom edge the same distance the first line of weakness is spaced from the first fold line, and the second fold line is preferably a line of weakness. The second permanent adhesive patterns typically include strips of adhesive disposed on the third panel first face between the third, fourth, and fifth lines of weakness and the first side edge, second side edge, and bottom edge, respectively; and typically further include strips of adhesive disposed on the first panel second face between the third and fourth lines of weakness and the first side edge and second side edge, respectively.

The longest dimension of the interior of the reply envelope formed from the intermediate is at least about six inches so that the reply envelope can receive an unfolded bank check therein. The first line of demarcation typically also extends into the third panel, and is discontinuous between the first and second lines of weakness.

The reply envelope closing flap dimension from the first line of demarcation to the third line of weakness is larger than the dimension of the outgoing address area from the first line of demarcation toward the second side edge, so that when the reply envelope closing flap is folded about the first line of demarcation said second flap sealingly engages the first face of the first panel and the closing flap completely covers any remaining portion of the outgoing address area. The portion of the first panel between the first line of demarcation and the third line of weakness typically comprises remittance stub indicia imaged on the second face thereof. Also postal bar coding is at some stage imaged on the first face of the first panel between the first line of weakness and the first fold line aligned with the outgoing address, while human readable address indicia is imaged on the outgoing address area. Security screening is typically provided on the second face of the first and second panels to provide confidentiality to the reply envelope.

According to the another aspect of the present invention a mailer type business form is provided comprising the following components: First, second, and third substantially equal size substantially opaque quadrate plies, the second ply sandwiched between the first and third plies, and each ply having a top face and a bottom face, first and second side edges, and first and second end edges. A first line of demarcation disposed parallel to the first side edge extending the majority of the dimension of at least the first and second plies parallel to the side edges, the first line of demarcation closer to the first side edge than the second side edge, and defining a flap in each of the first and second plies between the first line of demarcation and the first side edge. Outgoing address indicia imaged on the top face of the first ply, the first line of demarcation passing through the outgoing address indicia. Reply address indicia imaged on the bottom face of the second ply, the reply address indicia spaced from, and not intersected by, the first line of demarcation in the second ply and between the second side edge and the first line of demarcation. First permanent adhesive patterns provided on at least one of the first ply bottom face and second ply top face for defining the first and second plies into a reply envelope having permanent adhesive on first through third sides thereof. A reply envelope closing flap formed by the second ply flap, and having activatable adhesive on the top face thereof for sealing the reply envelope on a fourth side thereof. First and second aligned lines of weakness formed in the first and second and plies parallel to the end edges adjacent the second end edge of each, the first line of weakness spaced from the second end edge a distance large enough to contain postal address bar coding between the first line of weakness and the second end edge. Postal address bar coding provided on the top face of the first ply between the first line of weakness and the second end edge beneath the outgoing address indicia. Third and fourth lines of weakness formed in the first through third plies parallel to and spaced from each of the first and second side edges. The first through fourth lines of weakness defining tear-off strips providing for ready opening of the mailer; and second permanent adhesive patterns provided in at least some of the tear-off strips for holding the first through third plies together in the outgoing mailer.

The reply envelope closing flap dimension from the first line of demarcation to the third line of weakness is larger than the dimension of the outgoing address from the first line of demarcation toward the second side edge, so that when the reply envelope closing flap is folded about the first line of demarcation the second flap sealingly engages the top face of the first flap, the closing flap completely covering any remaining portion of the outgoing address indicia. A portion of the first ply between the first line of demarcation and the third line of weakness also typically comprises remittance stub indicia imaged on the bottom face thereof. The mailer has other features which are provided as a result of the Z-folding of the single sheet of paper of the intermediate to form the first, second and third plies, including an integral piece of paper between the first and second plies at the second end edge, and between the second and third plies at the first end edge.

According to still another aspect of the present invention a mailer type business form is provided by the Z-folding of a single sheet of substantially opaque paper having a length of at least about twelve inches, and comprising the following components: First, second, and third substantially equal size quadrate plies, the second ply sandwiched between the first and third plies, and each ply having a top face and a bottom face, first and second side edges, and first and second end edges. Outgoing address indicia imaged on the top face of the first ply. First permanent adhesive patterns provided on at least one of the first ply bottom face and second second ply top face for defining the first and second plies into a reply envelope having permanent adhesive on first through third sides thereof. First and second aligned lines of weakness formed in the first and second and plies parallel to the end edges adjacent the second end edge of each, the first line of weakness spaced from the second end edge a distance of approximately one-half inch. Postal address bar coding provided on the top face of the first ply between the first line of weakness and the second end edge beneath the outgoing address indicia. Third and fourth lines of weakness formed in the first through third plies parallel to and spaced from each of the first and second side edges. Second permanent adhesive patterns provided in at least some of the tear-off strips for holding the first through third plies together in the outgoing mailer. The first through fourth lines of weakness defining tear-off strips providing for ready opening of the mailer. And, the first and second plies being connected at the second end edge thereof by an integral paper connection, and the second and third plies connected together at the first end edge thereof by an integral paper connection.

It is the primary object of the present invention to provide an intermediate for a mailer, and a mailer, with a great deal of printable area or indicia, as well as a reply envelope, that is readily constructed and utilized, without the necessity for a window or patch. This and other objects of the invention will become clear from an inspection of the detailed description of the invention, and from the appended claims.

DETAILED DESCRIPTION OF THE DRAWINGS

Figure 1:
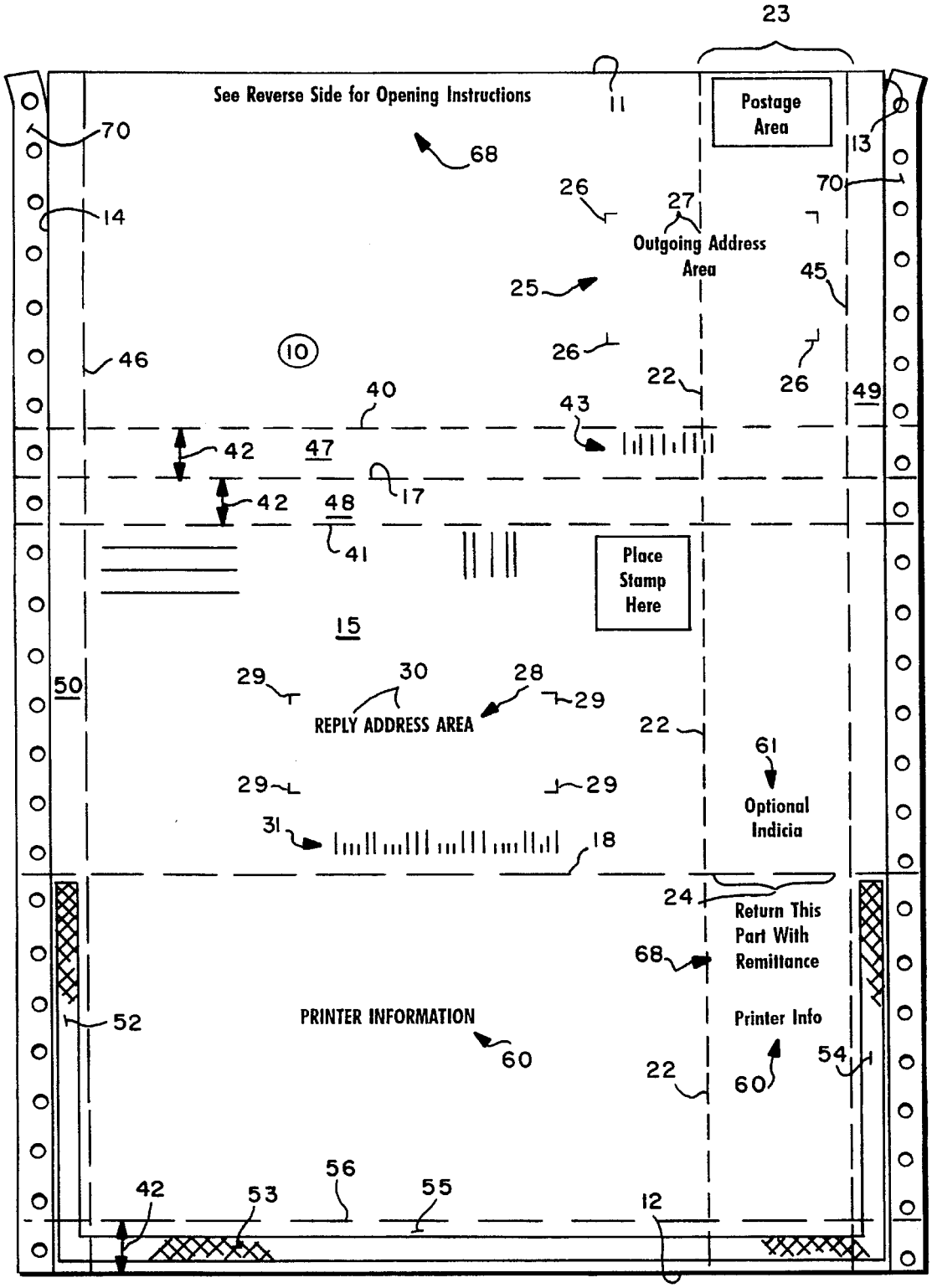
FIG. 1 is a top plan view of a first face of an exemplary intermediate according to the present invention.
Figure 2:
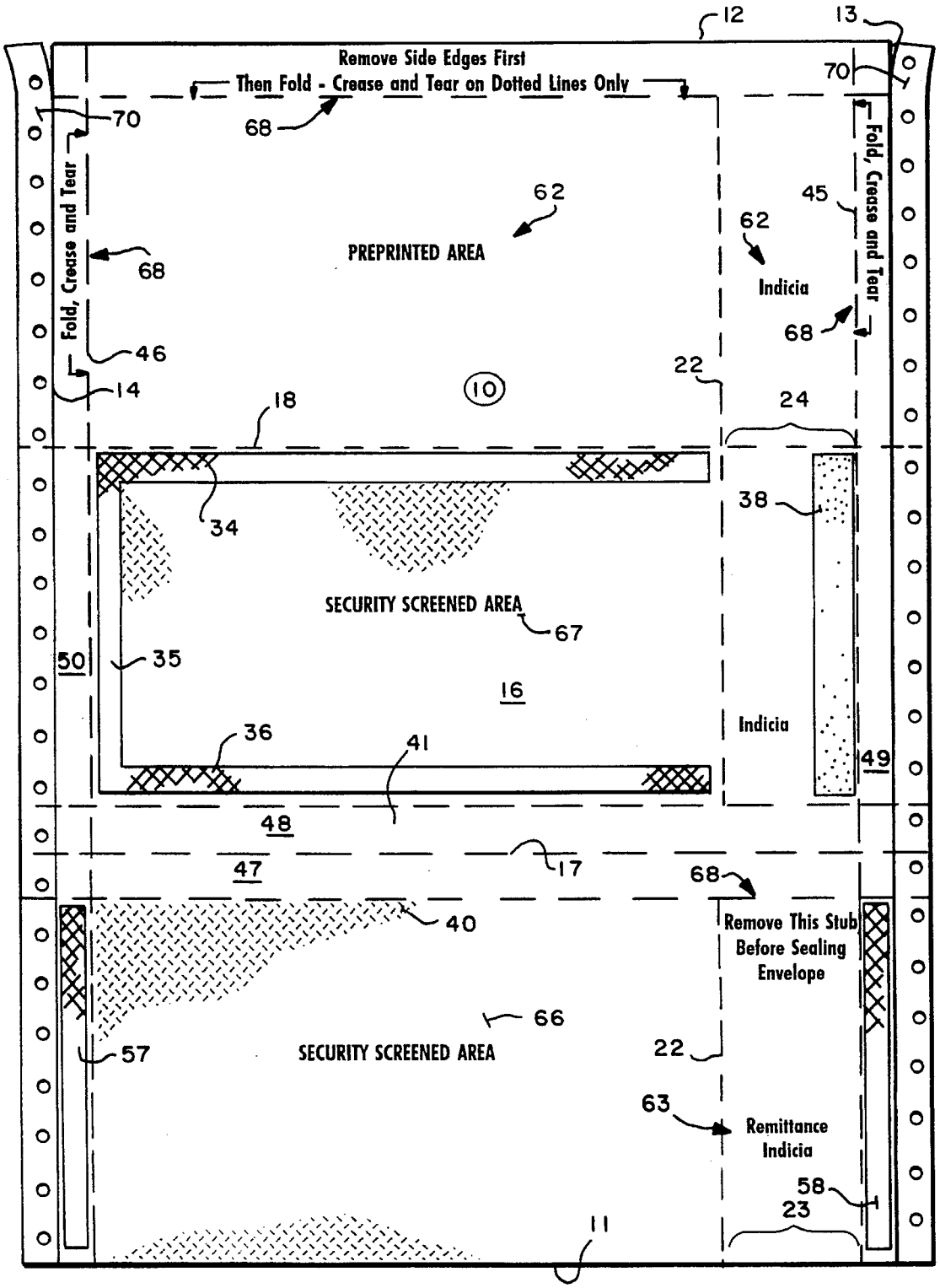
FIG. 2 is a plan view of the second face of the intermediate of FIG. 1.

An exemplary intermediate for a mailer type business form is shown generally by reference numeral 10 in FIGS. 1 and 2. It includes a quadrate sheet of substantially opaque paper (i.e. no windows and not fully translucent) having parallel top and bottom edges 11, 12, and parallel first and second side edges 13, 14, respectively. The side edges 13, 14 are perpendicular to the top and bottom edges 11, 12. The sheet also includes first and second faces 15 (FIG. 1) and 16 (FIG. 2), respectively.

Figure 3:
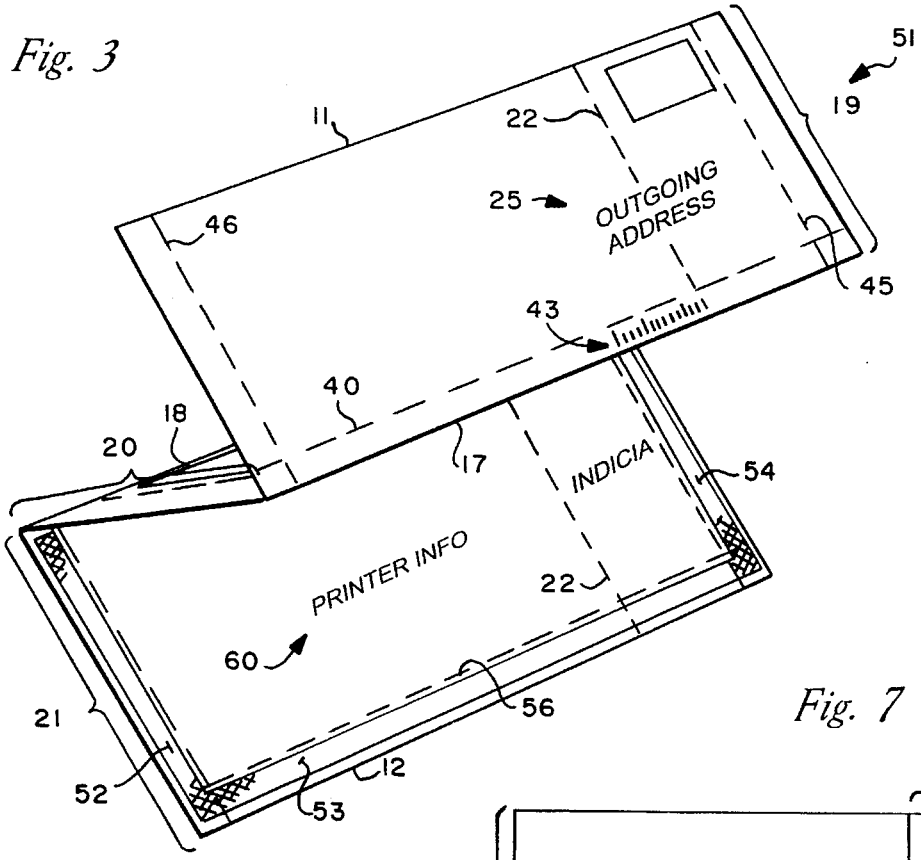
FIG. 3 is a top perspective view showing the intermediate of FIGS. 1 and 2 being folded into a mailer type business form.

First and second fold lines 17, 18 are provided parallel to the top and bottom edges 11, 12 defining the sheet of the intermediate 10 into three substantially equal-sized panels, first panel 19, second panel 20, and third panel 21 (see FIG. 3). The first panel 19 is between the top edge 11 and the first fold line 17, while the second panel 20 is between the first and third panels 19, 21 (that is between the fold lines 17, 18), and the third panel 21 between fold line 18 and bottom edge 12. The intermediate 10 fold lines 17, 18 may comprise the lines of weakness, such as perforation lines or die cut lines, or may merely be scored or creased lines.

The intermediate 10 also includes a first line of demarcation 22 disposed parallel to the first side edge 13 and extending the majority of the dimension of at least the first and second panels 19, 20 parallel to the side edges 13, 14. As seen in FIGS. 1 and 2 the first line of demarcation 22 is closer to the first side edge 13 than to the second side edge 14, and defines a flap 23 in the first panel 19, and a flap 24 in the second panel 20 between the line of demarcation 22 and the side edge 13. As seen in FIGS. 1 and 2 the line of demarcation 22 also preferably extends into the third panel 21, and preferably comprises a line of weakness (e.g. perforation line) at least in the first panel 19.

The intermediate 10 also includes means defining an outgoing address area 25 on the first face 15 of the first panel 19, the line of demarcation 22 passing through the outgoing address area 25 as seen in FIG. 1, and typically essentially bisecting the outgoing address area 25. The means defining the outgoing address area 25 may comprise the indicia "corners" 26, although other means may be provided, including changes in texture, tone, or color of the paper, or the area may not be distinguished except to a machine which will image address indicia thereon. Human readable address indicia—shown only schematically by the indicia 27 in FIG. 1—is ultimately imaged on the intermediate 10, such as after it passes through a printer.

The intermediate 10 also comprises means defining a reply address area 28 (see FIG. 1) on the same face 15 as the outgoing address area 25, but in the second panel 20. The reply address area defining means may comprise the comer indicia 29 as illustrated in FIG. 1, or may comprise any other typical means as is provided for the outgoing address area 25. Also at some point in time human readable reply address indicia—shown schematically at 30 in FIG. 1—is imaged in the area 28, and also postal address bar coding 31 is imaged in or adjacent to the area 28.

Figure 7:
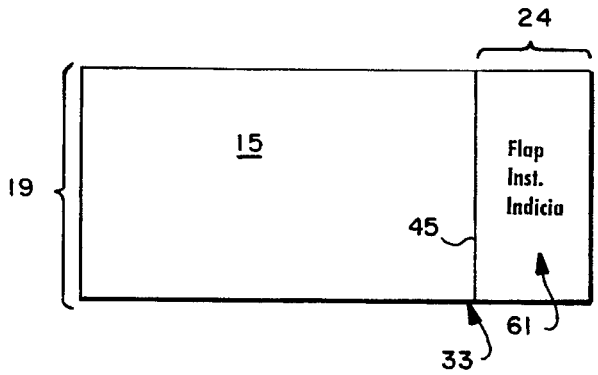
FIG. 7 is a bottom plan view of the reply envelope of FIG. 6 after it has been sealed.
Figure 6:
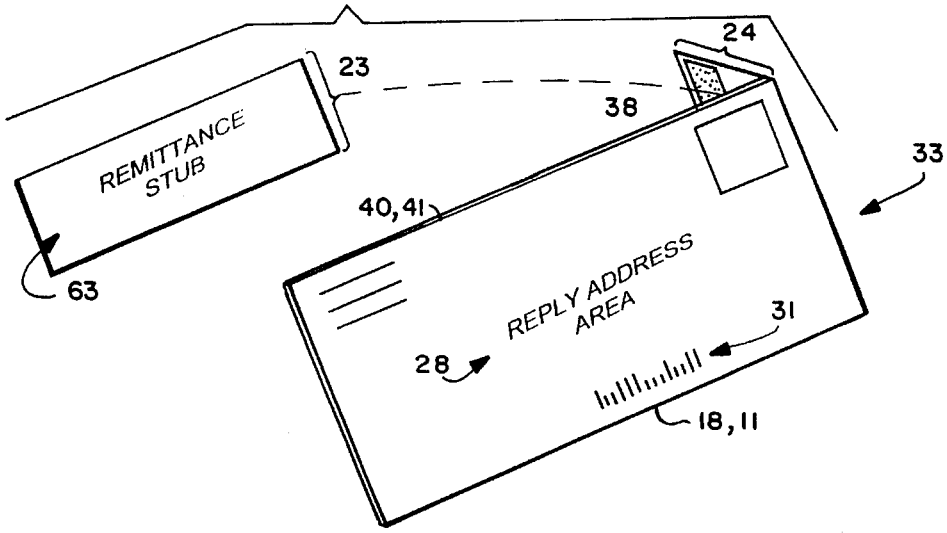
FIG. 6 is a top perspective view showing the reply envelope detached from the other components of the mailer of FIG. 3 in association with the remittance stub, and showing the flap of the reply envelope starting to be folded back.

First permanent adhesive patterns are provided on at least one of the first and second panel second faces 16 to define the first and second panels 19, 20 into a reply envelope 33 (see FIGS. 6 and 7 for example) having permanent adhesive on first through third sides thereof when the first and second panels 19, 20 are Z-folded about the first fold line 17 so that the second faces 16 thereof are in face to face engagement. FIG. 2 shows exemplary permanent adhesive patterns as continuous strips 34, 35, 36, the strips 34 and 36 being substantially parallel to each other and the strip 35 perpendicular thereto. Note that the strip 34 is immediately adjacent the second fold line 18 while the strip 36 is spaced from the first fold line 17. The permanent adhesive patterns may take any configurations not just the continuous strip forms illustrated at 34–36; for example they may be discontinuous strips, spaced elements, polygonal shaped components, or the like. Also any suitable adhesive can be utilized such as conventional heat seal adhesives, adhesives that seal by the application of pressure, or even rewettable adhesives.

The second panel flap 24 comprises a reply envelope closing flap having activatable adhesive 38 (see FIGS. 2, 5, and 6) on the second face 16, the adhesive 38 for sealing the reply envelope 33 on the fourth side thereof. In the preferred embodiment illustrated in the drawings the reply envelope 33 is a side opening envelope the flap 24 sealing the "right" side as viewed in FIG. 2. The adhesive 38 may comprise any suitable type, such as rewettable adhesive, pressure sensitive adhesive covered by a release strip, discontinuous elements rather than continuous elements, etc.

The intermediate 10 also includes first and second lines of weakness 40, 41 formed in the first and second panels 19, 20 respectively parallel to the edges 11, 12 and straddling the first fold line 17. The first line of weakness (e.g. perforation line) 40 is spaced from the first fold line 17 a distance 42 (see FIG. 1) which is sufficient (large enough) to contain postal address bar coding 43 (see FIG. 1) between the lines 40, 17 on the first face 15. However the first line of weakness 40 is not spaced so widely from the first fold line 17 that it interferes with the outgoing address area 25. The typical dimension 42 is about one half inch. The second fold line 41 is also spaced the distance 42 from the first fold line 17 so that the lines 40, 41 are aligned when the intermediate sheet of paper 10 is Z-folded about the fold line 17, as illustrated in FIG. 3.

Third and fourth lines of weakness 45, 46 are also formed in the first through third panels 19 through 21 parallel to and spaced from each of the edges 13, 14. The first through fourth lines of weakness 40, 41, 45, 46 define tear-off strips 47, 48, 49, and 50 providing for ready opening of a mailer—shown generally by reference numeral 51 in FIG. 3—constructed by Z-folding the sheet of the intermediate 10 about the fold lines 17, 18.

The intermediate 10 also comprises second permanent adhesive patterns provided in at least some of the tear-off strips 47–50 for holding the first through third panels 19 through 21 together in the outgoing mailer 51 configuration when the sheet 10 is Z-folded about the fold lines 17, 18 as illustrated in FIG. 3. In the preferred embodiment illustrated in the drawings the second permanent adhesive patterns include the continuous strips 52, 53, and 54 provided on the first face 15 of the third panel 21 in the tear-off strips 50, 55, and 49 respectively, the tear-off strip 55 being defined between the bottom edge 12 and the fifth line of weakness 56 which is parallel to the edge 12 and spaced a distance 42 therefrom so that the fifth line of weakness 56 is in alignment with the lines of weakness 40, 41 when the intermediate forming the sheet 10 is Z-folded as illustrated in FIG. 3. The permanent adhesive patterns 52–54 may have the same variation in composition and configuration as described above with respect to the patterns 34 through 36. The second permanent adhesive patterns also preferably include the strips 57, 58 seen in FIG. 2, provided on the second face 16 in the tear-off strip portions 50, 49, respectively, of the first panel 19.

Indicia may be printed wherever desired except on the first panel 19 first face 15 and the second panel 20 first face 15 to the left of line of demarcation 22 (as seen in FIG. 1). Note that the indicia printed on the second face 16 will typically be "upside down" with respect to the indicia printed on the first face 15. Various indicia that may be printed includes the information indicia 60 on the first face 15 third panel 21, optional indicia 61 printed on the first face 15 of the return envelope flap 24, indicia 62 printed on the third panel 21 second face 16, and remittance stub indicia 63 (see FIG. 2) imaged on the second face 16 of the first panel 19 flap 23. The indicia 62 to the right of the line of demarcation 22 in FIG. 2 also may be remittance stub indicia, but the remittance stub indicia 63 is particularly desirable because the user must detach the flap 23 before the reply envelope 33 can be utilized, allowing the user/recipient a clear chance to insert the remittance stub/flap 23 when detached along the line of demarcation/weakness 22.

The intermediate 10 also preferably includes security screened areas 66, 67 formed on the second face 16 of those portions of the first and second panels 19, 21 that will form the interior of the reply envelope 33, as illustrated in FIG. 2. The security screening is typically screen printed by any conventional technique normally prior to the time that the intermediate 10 is transported to the entity that will be printing the variable information on the intermediate 10 (such as the outgoing address indicia 27, the reply address indicia 30, etc.). Also various types of instruction indicia 68 can be imaged wherever desired.

As see in FIGS. 1 and 2, detachable tractor drive strips 70 may be provided for the intermediate 10 during processing. These drive strips 70 are conventional and facilitate handling of the intermediate 10 for printing or the like during manufacture of a mailer. The strips 70 are particularly desirable when the intermediate 10 is in continuous form, that is when the top and bottom edges 11, 12 thereof are really lines of weakness between the intermediate 10 and like intermediates. During normal processing, the strips 70 are slit off at an appropriate stage, exposing the edges 13, 14, although if desired the strips 70 may be maintained in the final mailer (the side edges 13, 14 then being outside the strips 70).

In constructing the mailer 51, after the intermediate 10 is detached from any other intermediates, and after slitting of the tractor drive edges 70, the intermediate paper sheet 10 is Z-folded as illustrated in FIG. 3 (typically by conventional folding equipment), and then is run through a suitable sealing machine for activating the adhesive patterns 34–36, 52–54, 57 and 58 (typically either heat sealing or pressure sealing conventional equipment). Typically the intermediate 10 as seen in FIGS. 1 and 2 has a length (between the edges 11, 12) of at least about twelve inches to ensure that all postal specs are met by the mailer 51 and the reply envelope 33; and the reply envelope 33 typically has a width of about 6⅜ inches so that it can easily receive a standard (six inch in length) check therein without folding. The mailer 51 has numerous portions thereof on which the various indicia 60, 61, 62, 63, etc. may be provided.

Figure 4:
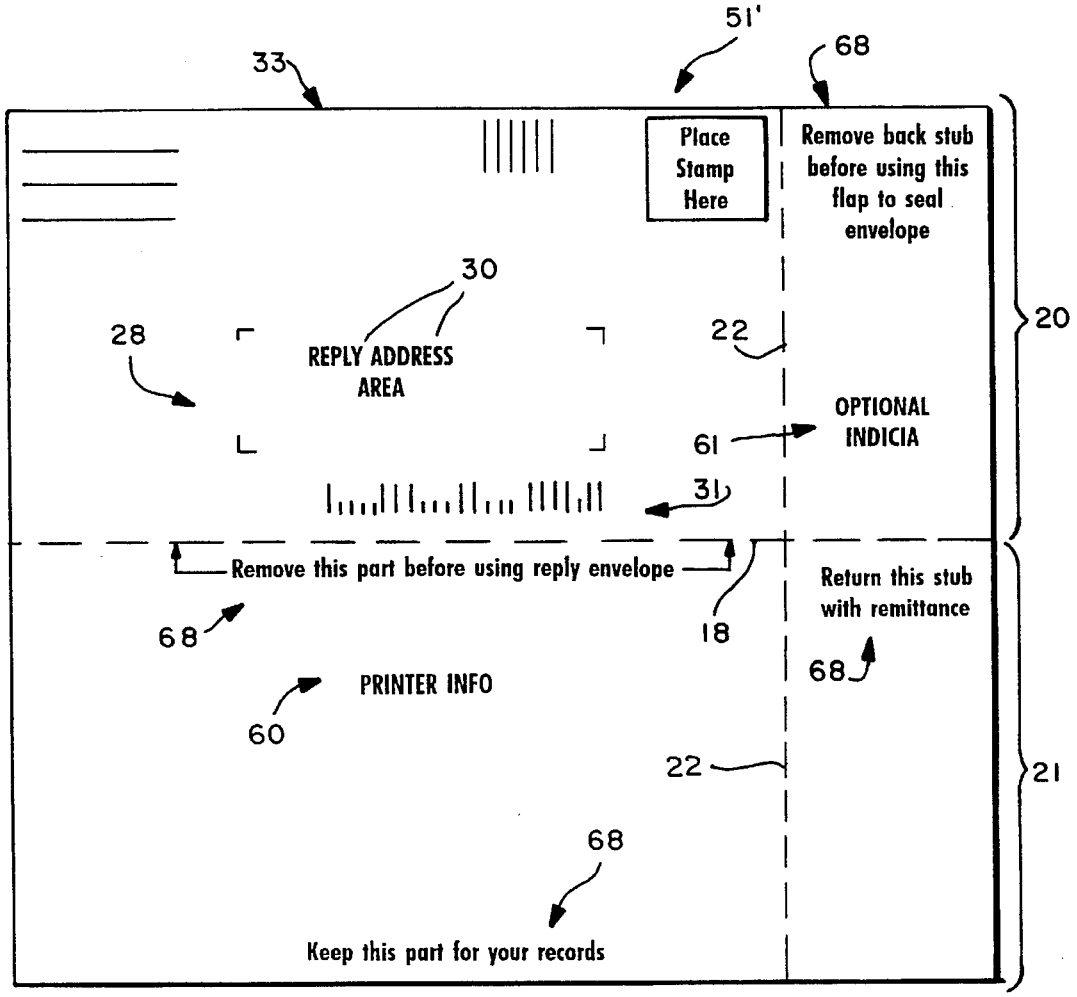
FIG. 4 is a first plan view of the mailer of FIG. 3 once it has been opened up, showing the reply address portion of the reply envelope.
Figure 5:
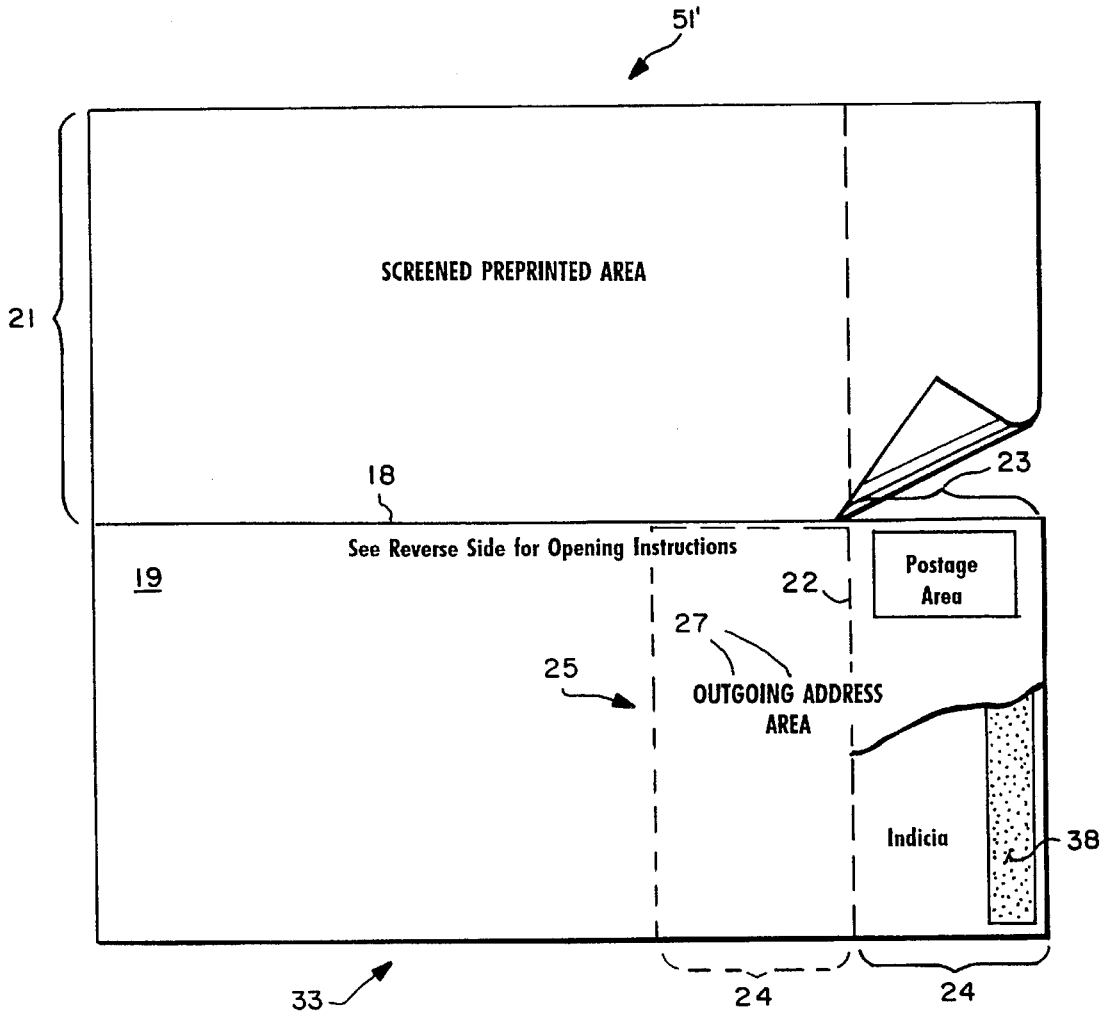
FIG. 5 is a second plan view of the mailer of FIG. 3 once it has been opened up, and indicating initiation of detachment of the remittance coupon and other components from the reply envelope.

When the outgoing addressee receives the mailer 51, the panels 19, 20, and 21 then comprise first, second, and third plies of the mailer 51, the then bottom face (16) of the first ply (19) in face to face relationship with the top face (16) of the second ply (20), and the then bottom face (15) of the second ply (20) in face to face engagement with the then top face (15) of the third ply (21). The mailer 51 may be easily opened by tearing along the perforation lines 45, 46 exposing the side edges of the opened up mailer, and by tearing along the perforation lines 40, 41, 56. When the outgoing addressee separates the tear-off strips 49, 50, 47, 48, and 55 in this manner, the resultant opened mailer 51' is illustrated in FIGS. 4 and 5.

The opened up mailer 51' has the third panel/ply 21 still primarily intact and connected by the fold line/line of weakness 18 to the reply envelope 33. In particular looking at FIG. 4, the outgoing addressee can easily read the information 60 when viewing the reply address indicia 30. As seen in FIG. 5, ultimately the panel 21 is separated along the line 18 (as shown starting to separate at the right hand side of FIG. 5) and then the flap 23 is detached along the line of demarcation/weakness 22 of the first panel/ply 19, as shown for part of the flap 23 in FIG. 5, thereby exposing the so activatable adhesive strip 38 on the reply envelope flap 24.

Detaching the flap 23 tears the outgoing address indicia 27 approximately in half, and the width of the flap 24 is such that when it is folded over (as indicated in dotted line at 24 in FIG. 5) it completely covers the remaining outgoing address indicia 27 in area 25. The adhesive 38 is then activated (e.g. wetted or a covering release strip is removed) and sealed after the remittance stub (either flap 23, or that portion of the third panel/ply 21 between the lines 22, 45) is inserted into the outgoing envelope through the open side thereof.

The intermediate and mailer according to the present invention have a number of advantageous results. All bar coding and postal markings are removed from the original outgoing envelope in the reply, including the original outgoing address being obliterated and then covered when sealing the reply envelope. The reply envelope offers all needed postal encoding for fast delivery, and can be printer variable, and both the outgoing and reply addresses are printer variable. Due to the large (at least twelve inch compared with eleven inch or less common prior art constructions) depth there is more room for nestling information inside of the mailer form instead of storing and nestling a reply envelope. The design is compact and easy to produce and store including on model 8121 heat seal equipment, or on conventional pressure seal equipment. The reply envelope size allows for a remittance check to be inserted without having to fold it, and three possible removable panels are provided which may comprise customer copy, discount coupon, remittance stub, or any other suitable elements. Also numbering can be applied with either variable or at factory locations, so that a number appears on the outside of the reply envelope, outgoing envelope, and all removable panels.

It will thus be seen that according to the present invention a simple and easy to construct, print, and utilize mailer has been provided, having a large amount of printable area, and a reply envelope, which preferably can accept a six inch personal check without folding, without the need for a window or patch. The return envelope flap also folds to the back of the reply envelope, as is most desirable for ease of use and aesthetics. While the invention has been herein shown and described in what is presently conceived to be the most practical and preferred embodiment it will be apparent to those of ordinary skill in the art that many modifications may be made thereof within the scope of the present invention, which scope is to be accorded the broadest interpretation of the appended claims so as to encompass all equivalent intermediates and business forms.

What is claimed is:

1. An intermediate for a mailer type business form, comprising:

a quadrate sheet of paper having parallel top and bottom edges, parallel first and second side edges perpendicular to the top and bottom edges, and first and second faces;

first and second fold lines parallel to said top and bottom edges, and defining said sheet into substantially equal-size first, second, and third panels, said first panel between said top edge and first fold line, and said second panel between said first and third panels;

a first line of demarcation disposed parallel to said first side edge extending the majority of the dimension of at least said first and second panels parallel to said side edges, said first line of demarcation closer to said first side edge than said second side edge, and defining a flap in each of said first and second panels between said first line of demarcation and said first side edge;

means defining an outgoing address area on said first face of said first panel, said first line of demarcation passing through said outgoing address area;

means defining a reply address area on said first face of said second panel, said reply address area spaced from, and not intersected by, said first line of demarcation in said second panel, said reply address area between said first line of demarcation and said second side edge;

first permanent adhesive patterns provided on at least one of said first and second panel second faces for defining said first and second panels into a reply envelope having permanent adhesive on first through third sides thereof when said first and second panels are Z-folded about said first fold line so that said second faces thereof are in face-to-face engagement;

a reply envelope closing flap formed by said second panel flap, and having activatable adhesive on said second face thereof for sealing a reply envelope on a fourth side thereof;

first and second lines of weakness formed in said first and second panels, respectively, parallel to said top and bottom edges and straddling said first fold line, said first line of weakness spaced from said first fold line a distance large enough to contain postal address bar coding between said first line of weakness and said first fold line on said first face, but said first line of weakness not interfering with said outgoing address area; third and fourth lines of weakness formed in said first through third panels parallel to and spaced from each of said first and second side edges;

said first through fourth lines of weakness defining tear-off strips providing for ready opening of a mailer constructed by Z-folding said sheet about said fold lines; and second permanent adhesive patterns provided in at least some of said tear-off strips for holding said first through third panels together in an outgoing mailer when said sheet is Z-folded about said fold lines.

2. An intermediate as recited in claim 1 wherein said first line of demarcation is a line of weakness in said first panel.

3. An intermediate as recited in claim 1 further comprising a fifth line of weakness formed in said third panel parallel to said bottom edge and spaced from said bottom edge the same distance said first line of weakness is spaced from said first fold line.

4. An intermediate as recited in claim 3 wherein said second fold line is a line of weakness.

5. An intermediate as recited in claim 3 wherein said second permanent adhesive patterns include strips of adhesive disposed on said third panel first face between said third, fourth, and fifth lines of weakness and said first side edge, second side edge, and bottom edge, respectively.

6. An intermediate as recited in claim 5 wherein said second permanent adhesive patterns further include strips of adhesive disposed on said first panel second face between said third and fourth lines of weakness and said first side edge and second side edge, respectively.

7. An intermediate as recited in claim 1 wherein the longest dimension of the interior of the reply envelope formed from said intermediate is at least about six inches, so that the reply envelope can receive an unfolded bank check therein.

8. An intermediate as recited in claim 1 wherein said first line of demarcation also extends into said third panel.

9. An intermediate as recited in claim 8 wherein said first line of demarcation is a line of weakness through said first, second and third panels, and is discontinuous between said first and second lines of weakness.

10. An intermediate as recited in claim 1 wherein said reply envelope closing flap dimension from said first line of demarcation to said third line of weakness is larger than the dimension of said outgoing address area from said first line of demarcation toward said second side edge, so that when said reply envelope closing flap is folded about said first line of demarcation said second flap sealingly engages said first face of said first panel and said closing flap completely covers any remaining portion of said outgoing address area.

11. An intermediate as recited in claim 10 wherein the portion of said first panel between said first line of demarcation and said third line of weakness comprises remittance stub indicia imaged on said second face thereof.

12. An intermediate as recited in claim 1 further comprising postal address bar coding imaged on said first face of said first panel between said first line of weakness and said first fold line aligned with said outgoing address area, and further comprising human readable address indicia imaged in said outgoing address area.

13. An intermediate as recited in claim 1 wherein the distance between said top and bottom edges of the unfolded sheet is at least twelve inches.

14. A mailer type business form, comprising:

first, second, and third substantially equal size quadrate substantially opaque plies, said second ply sandwiched between said first and third plies, and each ply having a top face and a bottom face, first and second side edges, and first and second end edges;

a first line of demarcation disposed parallel to said first side edge extending the majority of the dimension of at least said first and second plies parallel to said side edges, said first line of demarcation closer to said first side edge than said second side edge, and defining a flap in each of said first and second plies between said first line of demarcation and said first side edge;

outgoing address indicia imaged on said top face of said first ply, said first line of demarcation passing through said outgoing address indicia;

reply address indicia imaged on said bottom face of said second ply, said reply address indicia spaced from, and not intersected by, said first line of demarcation in said second ply and between said is second side edge and said first line of demarcation;

first permanent adhesive patterns provided on at least one of said first ply bottom face and second second ply top face for defining said first and second plies into a reply envelope having permanent adhesive on first through third sides thereof;

a reply envelope closing flap formed by said second ply flap, and having activatable adhesive on said top face thereof for sealing the reply envelope on a fourth side thereof;

first and second aligned lines of weakness formed in said first and second and plies parallel to said end edges adjacent said second end edge of each, said first line of weakness spaced from said second end edge a distance large enough to contain postal address bar coding between said first line of weakness and said second end edge;

postal address bar coding provided on said top face of said first ply between said first line of weakness and said second end edge beneath said outgoing address indicia;

third and fourth lines of weakness formed in said first through third plies parallel to and spaced from each of said first and second side edges;

said first through fourth lines of weakness defining tear-off strips providing for ready opening of said mailer; and second permanent adhesive patterns provided in at least some of said tear-off strips for holding said first through third plies together in said outgoing mailer.

15. A mailer as recited in claim 14 wherein said reply envelope closing flap dimension from said first line of demarcation to said third line of weakness is larger than the dimension of said outgoing address from said first line of demarcation toward said second side edge, so that when said reply envelope closing flap is folded about said first line of demarcation said second flap sealingly engages said top face of said first flap, said closing flap completely covering any remaining portion of said outgoing address indicia.

16. A mailer as recited in claim 15 wherein the portion of said first ply between said first line of demarcation and said third line of weakness comprises remittance stub indicia imaged on said bottom face thereof.

17. A mailer as recited in claim 14 further comprising a fifth line of weakness formed in said third ply parallel to said second end edge and spaced from said second end edge the same distance said first line of weakness is spaced from said second end edge.

18. A mailer as recited in claim 17 wherein said second permanent adhesive pattern includes strips of adhesive disposed between said third ply top face and said second ply bottom face adjacent said bottom end edge and said first and second side edges.

19. A mailer as recited in claim 14 wherein said first line of demarcation is also provided in said third ply aligned with said first line of demarcation in said first and second plies, and wherein said line of demarcation is a line of weakness in said first ply.

20. A mailer as recited in claim 14 wherein said first, second and third plies are of paper, and wherein said bottom first and second plies are connected together at said bottom end edge by an integral sheet of paper, and said second and third plies are connected together at said top end edge by an integral sheet of paper.

* * * * *